United States Patent [19]

Meyers

[11] Patent Number: 4,720,881

[45] Date of Patent: Jan. 26, 1988

[54] ANESTHESIA ACCESSORIES

[76] Inventor: William K. Meyers, P.O. Box 191, Payson, Ariz. 85541

[21] Appl. No.: 904,368

[22] Filed: Sep. 8, 1986

[51] Int. Cl.[4] ..... A61G 13/00

[52] U.S. Cl. ..... 5/434; 5/437; 5/440; 5/503; 5/507; 5/508; 269/322

[58] Field of Search ..... 5/60, 71, 72, 77, 431, 5/432, 434, 437, 440, 503, 507, 508; 81/3.08, 3.4; 248/68.1, 74.2; 269/322, 323, 328

[56] References Cited

U.S. PATENT DOCUMENTS

| | | | |
|---|---|---|---|
| 2,053,246 | 9/1936 | Lurcott | 81/3.4 |
| 2,913,740 | 11/1959 | Eldridge | 248/68.1 X |
| 3,243,828 | 4/1966 | McCarty | 5/437 |
| 3,347,544 | 10/1967 | Uffenorde | 5/434 X |
| 3,476,256 | 11/1969 | Anderson | 5/512 X |
| 3,696,920 | 10/1972 | Lahay | 206/63.2 R |
| 4,149,635 | 4/1979 | Stevens | 206/370 |
| 4,195,734 | 4/1980 | Boner et al. | 206/558 |
| 4,266,669 | 5/1981 | Watson | 269/322 X |
| 4,489,454 | 12/1984 | Thompson | 5/503 |
| 4,553,724 | 11/1985 | St. Amand | 248/68.1 |

*Primary Examiner*—Alexander Grosz
*Assistant Examiner*—Michael F. Trettel
*Attorney, Agent, or Firm*—Warren F. B. Lindsley

[57] ABSTRACT

This invention is an anesthesia accessories unit which is adapted to be placed and supported on an end portion of a patient's bed structure normally a hospital operating room table. The anesthesia accessories unit includes a primary tray assembly having the following items supported thereon or forming a portion thereof (1) a support hole assembly adapted to receive various syringe structures and other items therein in a neat and orderly fashion; (2) a headrest assembly adapted to receive a patient's head thereon in proper relationship to the drugs and medicine needed; (3) an instrument holder compartment adapted to receive instruments therein; (4) a drape frame assembly adapted to be erected over the patient's head and receive a surgical drape or cover member thereon in an elevated position relative to the patient's head; (5) a needle remover assembly allowing the anesthesia provider to remove covers and needle members with the use of only one hand; (6) an intravenous tubing holder assembly adapted to receive and anchor an intravenous tubing assembly; (7) an attachment assembly adapted to receive and hold various items such as tape, scissors, etc.; (8) a tube tree assembly adapted to receive air supply tubes and the like thereon to hold in an elevated condition; and (9) a transducer pole assembly adapted to attach a transducer member thereto which then is automatically moved with raising and lowering of the operating table structure. The intravenous tubing holder assembly includes a first tube holder adapted to receive an intravenous tubing therein and a stop cock holder operable to hold a stop cock therein so as to be readily operable by one hand of the anesthesia provider.

12 Claims, 15 Drawing Figures

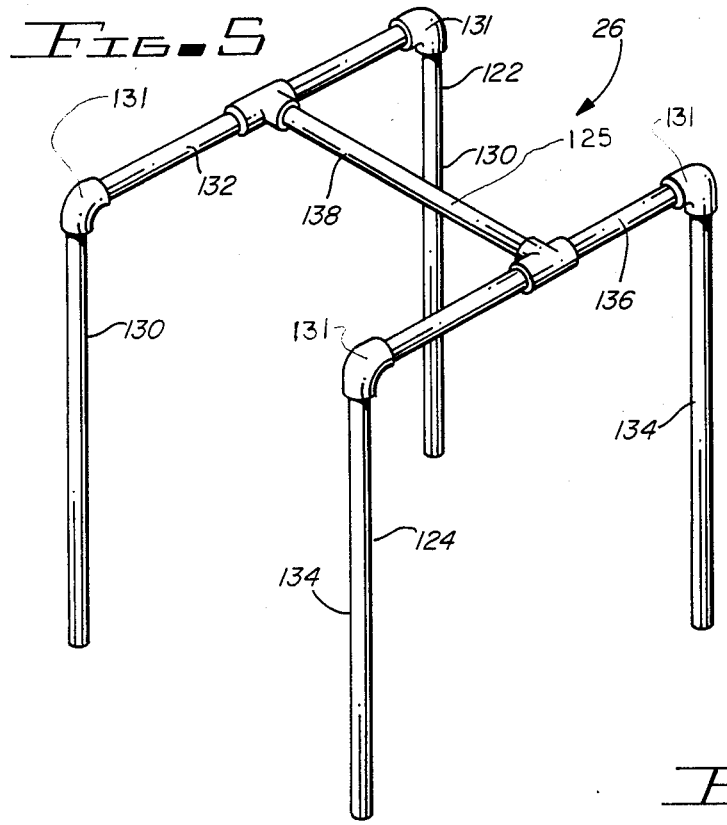
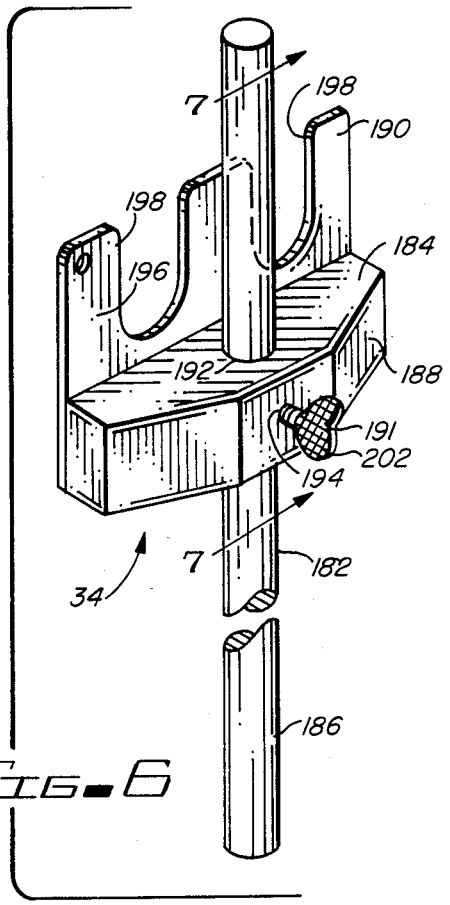
FIG. 7
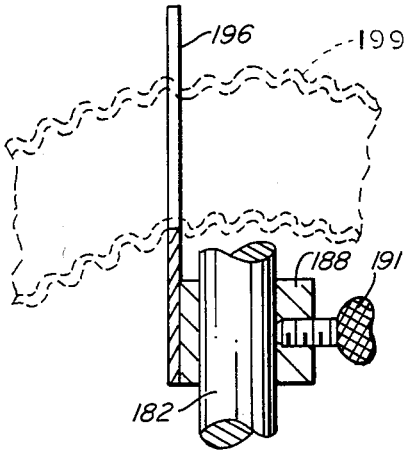
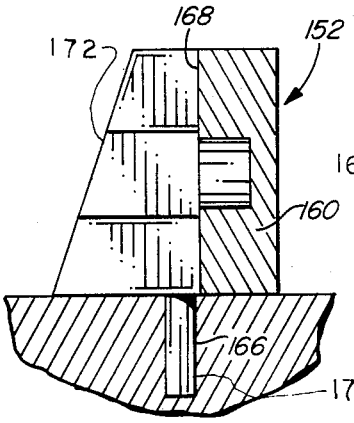
FIG. 8
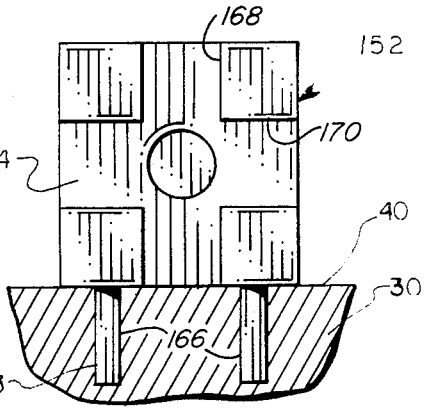
FIG. 9
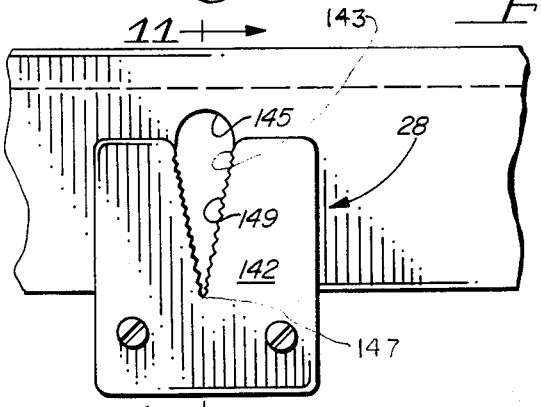
FIG. 10
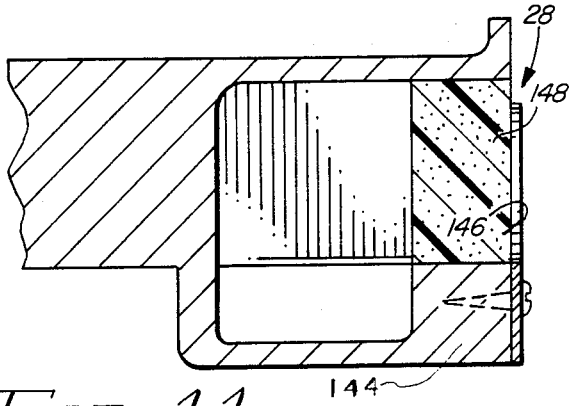
FIG. 11

ANESTHESIA ACCESSORIES

BACKGROUND OF THE INVENTION

The immediate working environment of an anesthesia provider (Anesthesiologist or Anesthetist) by design is a very confined space. The practice of anesthesia today is a highly technical science and as this science progresses, this confined space becomes more congested. Items which surround the anethesia provider include numerous electrical monitoring devices, machines that mix anesthetic gases, ventilate a patient's lungs, evacuate fluids, administer and warm fluids, and warm patients. An elaborate array of medications, syringes, needles, tubings of all types, laryngoscopes, and airways line the flat surfaces of the above mentioned machines. All such items must be within easy reach for adjustment, manipulation, and administration without fumbling, error, or loss of time. Induction and eduction of anesthesia, the two most critical periods of anesthetic procedure, are two such times when various items must be found quickly or almost blindly.

There has never been a standardization of such equipment and supplies, and the choice has been left entirely to personal preference. The anesthesia provider routinely finds himself moving from one operating room to another or being relieved by a colleague. Therefore, the arrangement of accessories may become inconsistent.

During the induction of general anesthesia, the presence of a second person standing by to lend assistance with certain items is needed; or, if not essential, at least helpful. This requires the utilization of an individual who has his or her own duties to perform as well, so time is of the essence.

Performance of the many tasks of the anesthesia provider requires a certain amount of dexterity. He or she has to constantly provide oxygen and other anesthetic gases to a patient, who may otherwise not be breathing on his own. This is done by compressing a rubberized bag in a rhythmical fashion with one hand while accomplishing other tasks with the other.

PREFERRED EMBODIMENT OF THE INVENTION

The anesthesia accessories unit of this invention is adapted to be placed upon an operating table and to rest on an end portion thereof with the patient's head to be supported and centered thereon. The anesthesia accessories unit includes a primary tray assembly having the following items supported on or forming a portion thereof (1) a support hole assembly; (2) a head rest assembly; (3) an instrument holder compartment; (4) a drape frame assembly; (5) a needle remover assembly; (6) an intravenous injection holder assembly; (7) an attachment assembly; (8) a tube tree assembly; (9) a transducer central venous pressure pole assembly; (10) an endotracheal tube holder; (11) a suction tube retainer; and (12) a general tubing and wire retainer. The primary tray assembly includes a main support body adapted to be placed adjacent to a patient's shoulder with his head portion rested upon a central portion of the subject main support body. The support hole assembly includes a plurality of various sized holes through the main support body positioned on opposite sides of the patient's head and adapted to contain tubing material, syringes, or other such items. The head rest assembly includes a padded cushion member adapted to receive the patient's head portion thereon and to selectively hold the same in a level or elevated position. The instrument holder compartment is a cavity in the main support body adapted to receive and support an instrument therein. The drape frame assembly is of a tubular construction to be supported in the support hole assembly and extended above the patient's head to hold surgical drapes elevated therefrom. The needle remover assembly is adapted to remove the sanitary covers from syringe needle assemblies or actually unscrew a needle member therefrom. The intravenous injection holder assembly includes a tube holder and an adjacent stop cock holder. These are provided on each side of the patient's head and adapted to receive the intravenous tubing and stop cock control members therein for easy accessibility and one hand operation. The attachment assembly is a plurality of peg members which are adapted to hold items such as tape, scissors, instruments, etc. The tube tree assembly is a specially designed device adapted to be placed within one of the holes in the support hole assembly and having a special frame structure to hold the breathing circuit and the like in an elevated position to provide proper support. The transducer pole assembly is of a special design adapted to hold transducer members in a fixed elevated position relative to the patient. This is important as, in the prior art, the transducers had to be moved and the monitor recalibrated every time the operating table was raised and lowered. With the anesthesia accessories unit of this invention, the transducers are automatically moved with the operating table which is of extreme importance, likewise a central venous pressure manometere can be attached to this assembly for the aforementioned rational.

ADVANTAGES OF THE INVENTION

The anesthesia accessories unit is designed to provide order and consistency to a specific portion of the anesthesia provider's environment, that being the area immediately adjacent to and including the patient's head. It is this area where a large portion of the anesthesia provider's attention is directed, and a majority of the technical aspects of giving anesthesia are performed and surveyed. It provides orderly arrangement with immediate access to a laryngoscope, drugs, endotracheal tube, airway, and intravenous line insertion points, to name only a few, within inches of where they will be utilized.

The advantages of such a device include the following:

1. Various compartments and attachments are incorporated to receive instruments, syringes, tubes, and drugs, and it is less likely that any of them will be misplaced during the administration of an anesthetic.
2. Increased safety for the patient as the anesthesia provider can focus his or her attention more consistently in the immediate area of the head of the patient rather than constantly averting it while reaching for needed items.
3. More efficient use of precious induction/eduction time by the anesthesia provider and other personnel who may have to lend assistance on behalf of the anesthetized patient.
4. Increased convenience for the anesthesia provider.
5. Increased accuracy of monitoring devices, such as those for invasive monitoring of arterial blood pressure, central venous pressure, or pulmonary artery pressures. The pressure transducer, which is usually mounted on an intravenous pole next to the operating table, may be mounted on the anesthesia accessories unit. This allows maintenance of constant static patient-transducer level relationships as the operating table is raised or lowered. This eliminates the need for repeated calibration of the monitor each time the table is repositioned.

6. It is economical in that the anesthesia accessories unit is a durable plastic tray which requires a one time investment. This means less cost to be passed on to the patient than with a disposable unit.

7. Low maintenance. The anesthesia accessories unit is made of lightweight, durable, non-static producing, and easily plastic material.

8. Adaptability. Varying combinations of components make the anesthesia accessories unit usable in most surgeries, even where differing patient positions are required.

9. Protection of the patient's face and airway. During most types of surgical procedures, surgical drapes are suspended over the patient's face. The anesthesia accessories unit provides a means by which these drapes do not obscure the view of the face and airway by the anesthesia provider, thus preventing kinked endotracheal tubes, missed regurgitation, and undue facial pressure from retractors both human and instrumental.

OBJECTS OF THE INVENTION

One object of the anesthesia accessories unit of this invention is to provide a structure which can be placed on an operating table for receiving and supporting a patient's head; provides receptacles for instruments and materials to be used to support anesthetic procedures at the sides of the patient's head; and instruments and materials are readily and conveniently available to an anesthesia provider without distracting from the care of the patient.

One further object of this invention is to provide an anesthesia accessories unit which is formed with openings, recesses, and compartments adapted to receive specific instruments and materials in a predetermined arrangement so they are in the same array each time and that all airway supportive devices are readily available and so that with familiarization, the anesthesia provider can immediately reach to the same place each time for a needed article.

One other object of this invention is to provide an anesthesia accessories unit which can be constructed of a material such as plastic which can be easily cleaned.

Still, one further object of this invention is to provide an anesthesia accessories unit which is economical to manufacture; easy to clean and sterilize; and substantially maintenance free.

Various other objects, advantages, and features of the invention will become apparent to those skilled in the art from the following discussion, taken in conjunction with the accompanying drawings, in which:

FIGURES OF THE INVENTION

FIG. 5 is a perspective view of a drape frame assembly of the anesthesia accessories unit of this invention;

FIG. 6 is a perspective view of a tube tree assembly of this invention;

FIG. 7 is an enlarged fragmentary sectional view taken along line 7—7 in FIG. 6;

FIG. 8 is an enlarged sectional view taken along line 8—8 in FIG. 1;

FIG. 9 is a front elevational view similar to FIG. 8 showing a stop cock holder of this invention as mounted in the primary tray assembly of the anesthesia accessories unit;

FIG. 10 is a fragmentary side elevational view illustrating a needle remover assembly of this invention;

FIG. 11 is a fragmentary sectional view taken along line 11—11 in FIG. 10;

Figures 1, 2, 3, 4:
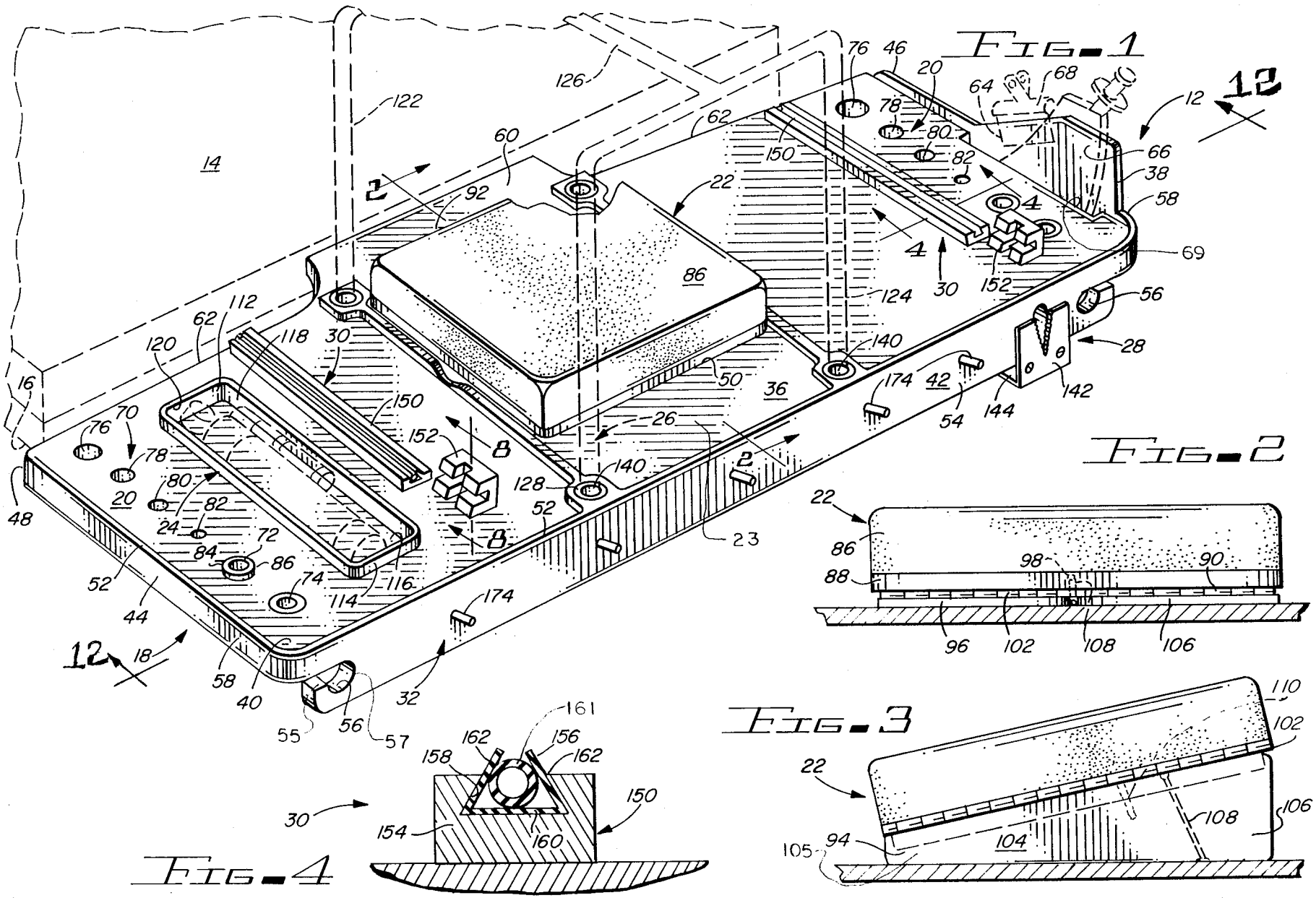
FIG. 1 is a perspective view of an anesthesia accessories unit of this invention as mounted on an end portion of a hospital operating room table structure.
FIG. 2 is an enlarged fragmentary sectional view taken along line 2—2 in FIG. 1.
FIG. 3 is a view similar to FIG. 2 having a head rest assembly shown in an elevated position.
FIG. 4 is an enlarged fragmentary sectional view taken along line 4—4 in FIG. 1.

The following is a discussion and description of preferred specific embodiments of the anesthesia accessories unit of this invention, such being made with reference to the drawings, whereupon the same reference numerals are used to indicated the same or similar parts and/or structure. It is to be understood that such discussion and description is not to unduly limit the scope of the invention.

DESCRIPTION OF THE INVENTION

Referring to the drawings in detail and in particular to FIG. 1, an anesthesia accessories unit, indicated generally at 12, shown as mounted on a hospital operating room table member 14 and generally supported on an end portion 16 thereof. The tray assembly 12 is adapted to receive and support a head portion (not shown) of an operating room patient thereon for accessibility by the anesthesia provider in a manner to be described thereinafter.

The anesthesia accessories unit 12 includes a primary tray assembly 18 having supported thereon or forming a portion thereof the following elements; (1) a support hole assembly 20; (2) a head rest assembly 22 mounted on a central portion 23 of the tray assembly 18; (3) an instrument holder compartment 24; (4) a drape frame assembly 26; (5) a needle remover assembly 28; (6) an intravenous feeder holder assembly 30; (7) an attachment assembly 32 secured to a front portion of the tray assembly 18; (8) a tube tree assembly 34; and (9) a transducer pole assembly 36.

The primary tray assembly 18 includes a main support body 36 having an upright connector wall 38 along a front side thereof. The main support body 36 includes a top wall 40; a front wall 42; opposed side walls 44 and 46; and a back wall 48.

The top wall 40 is generally a flat surface having a central indentation 50 and a peripheral ridge portion 52. The ridge portion 52 is adapted to contain any spilled liquids or instruments on the top surface.

The front wall 42 is formed with a vertical surface 54 and a tube connector section 56 formed at each outer end thereof. Each tube connector section 56 is formed with a slot portion 55 which leads into a circular opening 57. This allows a plastic tube member to be inserted through the slot section 55 into the circular opening 57 to hold same in a desired elevated position.

The back wall 48 is formed with a protruding central portion 60 integral on each side thereof with an arcuate portion 62. The central portion 60 is adapted to lie under a patient's neck portion for support of a patient's head portion on the head rest assembly 22 as will be explained. The arcuate portions 62 are adapted to extend outwardly and inwardly from the central portion 60 so as to not interfere with a patient's shoulder portion.

The connector wall 38 extends above the top wall 40 and it consists of an inclined forward portion 64 integral with a main body portion 66. A clip member 68 is shown in dotted lines which is adapted to clip a packaged tracheal tube therein and hold same in proper position for use by the anesthesia provider. Additionally, it is noted that an elongated rectangular opening 69 is formed within the top wall 40 so that the package to be held by the clip member 68 extends upwardly therethrough as shown in FIG. 1.

As noted in FIG. 1, the support hole assembly 20 includes a plurality of syringe hole members 70; a support hole member 72; and a tube clamp hole member 74. The syringe hole member 70 consists of a first hole 76, a second hole 78, a third hole 80, and a fourth hole 82. The hole members 70 can be of various size diameters so as to hold likewise different sizes of syringe members.

The support hole member 72 is formed with a support hole 84 having a support grommet 85 therein. The support grommet 86 is preferably constructed of a rubber resilient material and the use thereof will be explained.

The tube clamp hole member 74 is adjacent to the anesthesia provider and can be used to crimp a plastic tube member to the off position and insert the same within the tube clamp hole member 74 for ceasing fluid or air flow therethrough. As shown in FIGS. 1, 2, and 3, the headrest assembly 22 includes a headrest cushion 86 mounted upon a support member 88 which, in turn, is supported on a leg assembly 90. The headrest cushion 86 includes a generally square padded cushion member 92 adapted to receive a patient's head portion thereon. The support member 88 is a rectangular plate structure to which the padded cushion member 92 is attached.

The leg assembly 90 includes a first leg member 94; a second leg member 96; a bias assembly 98; and a pair of hinge members 102. The hinge members 102 are to connect respective one's of the leg members 94, 96 to the support member 88. Each leg member 94, 96 is formed with a tapered body section 104 which increases in width from a forward portion 105 to an outer portion 106 for reasons to become obvious.

The bias assembly 98 is formed with a headrest elastic member 108 which is operable to bias the support member 88 towards the top wall 40 and leg elastic members 110. A leg elastic member 110 is attached to each respective one of the leg members 94, 96 and to the support member 88 and operable to bias same inwardly into abutting engagement with the support member 88.

The hinge members 102 are of a piano hinge type which provides the pivotal connection of the leg members 94, 96 to the outer parallel edges of the support member 88. Preferably, the hinge members 102 are only moveable outwardly to the perpendicular position as shown in FIG. 3 and inwardly 90 degrees and to the clamped relationships against the support member 88.

Figure 12:
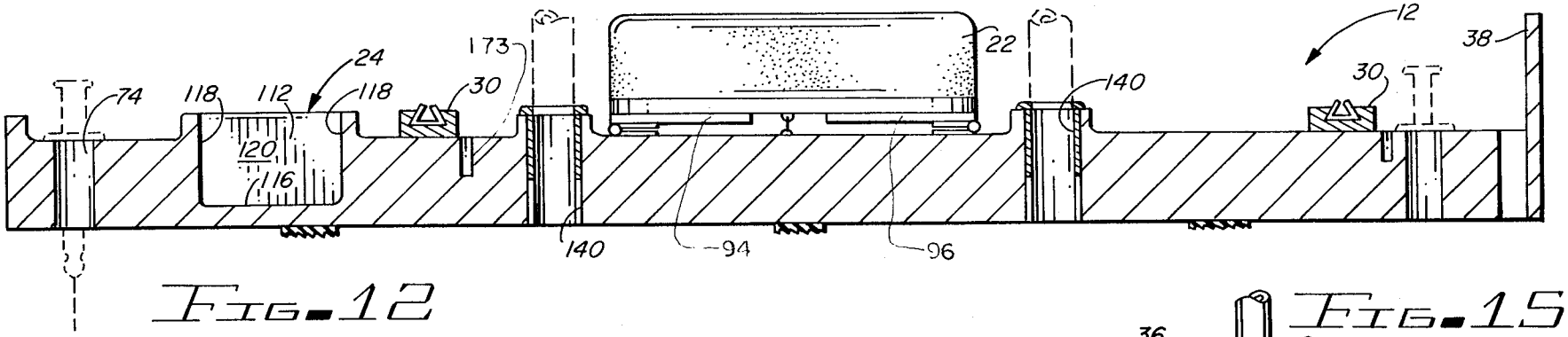
FIG. 12 is a sectional view taken along line 12—12 in FIG. 1.

As shown in FIGS. 1 and 12, the instrument holder compartment 24 consist of a rectangular cavity 112 having a peripheral edge section 114 thereabout. The rectangular cavity 112 is formed with a bottom wall 116, opposite side walls 118, and opposite end walls 120. The instrument holder compartment 24 is adapted to hold a laryngoscope therein as indicated in dotted lines in FIG. 1 so as to be easily and instantly available to the anesthesia provider.

As shown in dotted lines in FIG. 1 and the perspective view of FIG. 5, the draped frame assembly 26 includes an inner support assembly 122; an outer support assembly 124; and a connector member 125 to interconnect the support assemblies 122, 124. The inner support assembly 122 is formed by parallel support tubes 130 interconnected by connector members 131 to a top support tube 132. The outer support assembly 124 is similarly constructed having parallel support tubes 134 interconnected as by connector members 131 to a support tube 136. The connector member 126 consists of a transverse tube member 138. The lower ends of the support tubes 130, 134 are mountable within grommet members 140 held within support holes 128 in the primary tray assembly 18 in the main support body 36 FIG. 1.

As noted in FIGS. 10 and 11, the needle remover assembly 28 includes a needle plate member 142 secured against the vertical surface 54 of the front wall 42; a receiving tray member 144 which may be placed under the main support body 36; an entrance opening 145 in the front wall 42; and a foam member 146 placed about the entrance opening 145. The needle plate member 142 includes a connector plate section 146 having an inner surface 148 and serrated edges 149. The serrated edges 149 are of a V-shaped extending from a point 147 upwardly to an upper portion 143 as shown in FIG. 10 and defines a V-shaped opening.

As seen in FIGS. 1, 4, 8, and 9, the intravenous feeder holder assembly 30 is adapted to hold and control fluid flow through a stop cock member having a plastic tube member attached thereto. The intravenous feeder holder assembly 30 includes a tube holder assembly 150 secured to the top wall 40 of the main support body 36 on each side of the central indentation 50; and a stop cock holder 152 secured adjacent to each of the tube holder assemblies 150 (See FIG. 1).

Each tube holder assembly 150 includes a holder support body 154 having a tube clamp member 156 mounted therein. The holder support body 154 has a central, longitudinally extended triangular cavity 158 therein.

The tube clamp member 156 is preferably constructed of a flexible resilient material having a bottom wall portion 160 integral with opposite inclined side wall portions 162. As shown in FIG. 4, the tube clamp member 156 is adapted to snuggly fit within the triangular cavity 158 so as to receive a plastic conveyance tube member 161 therein. The tube holder assembly 150 assures that the plastic tube member 161 which is normally containing nutrients for intravenous feeding of the patient member, can be carefully monitored and controlled by the anesthesia provider.

Each stop cock holder 152 is provided with a cock support body 164 having a pair of connector legs 166 connected thereto. Each support body 164 is provided with a transverse vertical slot 168; a transverse horizontal slot 170 intersecting the vertical slot 168; and an inclined front wall 172. It is noted that the support cock body 164 is adapted to receive a cock member therein so as to allow the anesthesia provider to open and close a valve thereon with one hand for ease of operation.

The connector legs 166 are peg-like structures which are adapted to be mounted in similar holes 173 in the top wall 40 of the main support body 36.

Figure 15:
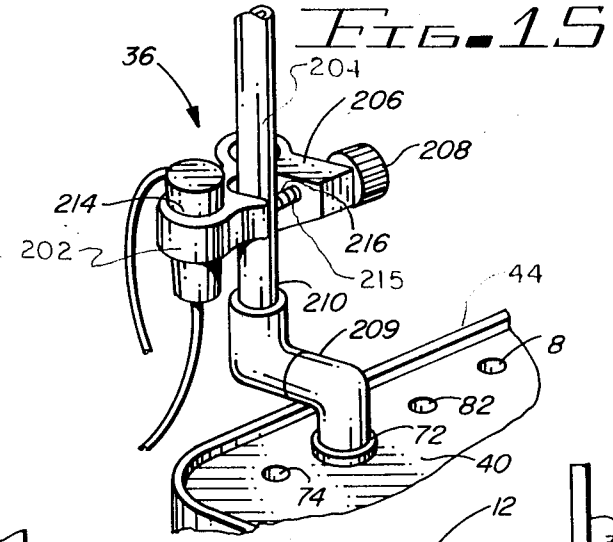
FIG. 15 is a perspective view of a transducer pole assembly of this invention.
Figure 13:
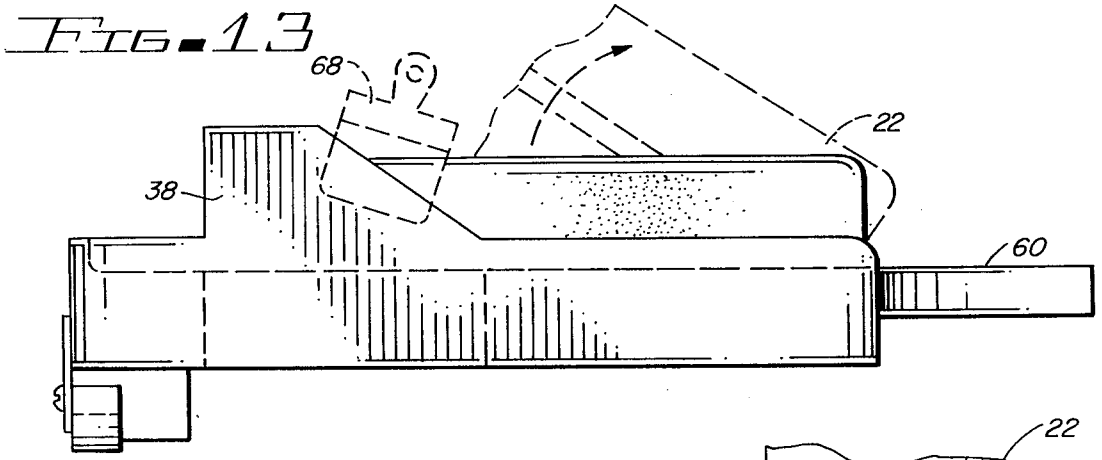
FIG. 13 is a side elevational view of the anesthesia accessories unit of this invention.

As seen in FIG. 15, the transducer pole assembly 36 consists of a support pole member 204 constructed of a tubular material; a transducer support member 206 and a connector member 208 to attach the transducer support member 206 to the support pole member 204.

The support pole member 204 is provided with an offset end section 209 integral with an upright main support section 210. The offset support section 209 is operable to place the transducer support member 206 outwardly of a respective side wall 44, 46 of the primary tray assembly 18.

The transducer support member 206 is provided with a main support block section 202 having support openings 214 therethrough. The support block section 202 is formed with a threaded connector opening 215 in order to receive the connector member 208 therein. More particularly, the connector member 208 is a screw member 216 adapted to be received within the connector opening 215 and placed against the main support section 210 of the support pole member 204 for securing same after vertical adjustment of the transducer support member 206.

Figure 14:
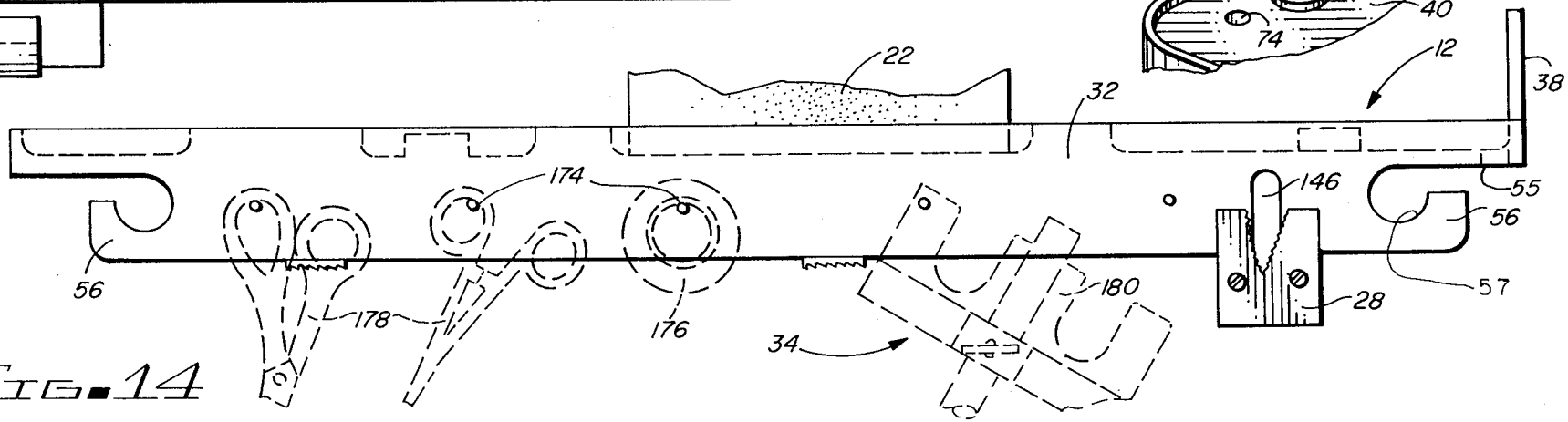
FIG. 14 is a front elevational view of the anesthesia accessories unit of this invention having various items to be carried thereon illustrated in dotted lines.

As noted in FIG. 1, the attachment assembly 32 includes a plurality of support peg members 174 extended outwardly from the vertical surface 54 from the front wall 42 and adapted to support thereon, as noted in FIG. 14 in dotted lines, a roll of tape 176, scissors 178, and various instruments 180.

As shown in FIG. 6, the tube tree assembly 34 includes an upright support pole member 182 having a tube support member 184 attached thereto. The support pole member 182 may be constructed of a plastic tubular member having a support end portion 186 adapted to be placed within one of the grommet hole members 72, 128 in the primary tray assembly 18. The tube support member 184 includes a main support block member 188 having a tube support member 190 secured thereto; and an anchor member 191 selectively secure the support member 188 to the support pole member 182 as will be explained.

The support block member 188 can be of an irregular shape having a vertical connector pole 192 and a screw hole 194. The connector hole 192 is adapted to snuggly receive the support pole member 182 therein. The screw hole 194 is provided with internal threads adapted to receive the anchor member 191.

The tube support member 190 is formed with a plate section 196 having spaced U-shaped slot sections 198 therein. The slot sections 198 are adapted to receive an air passage corrugated tube member 199 (FIG. 4) therein for vertical and lateral support.

The anchor member 191 is preferably a set screw member 202 which can be readily rotated to be placed against the support pole member 182 to anchor same after vertical adjustment of the tube support member 194.

USE AND OPERATION OF THE INVENTION

In the use and operation of the anesthesia accessories unit 12 of this invention, the same is placed upon an end portion of the patient's operating room table member so as to rest on a top surface thereof. The central indentation 50 of the main support body 36 is placed under the patient's head portion so that the head portion is to rest upon the head rest cushion 86 of the head rest assembly 22. The connector wall 38 is operable to receive the clip member 68 thereon and to hold a tracheal tube in a sterile package thereon inserted through the rectangular opening 69 as indicated in FIG. 1.

The support hole assembly 70 includes the syringe hole members 76, 78, 80, and 82 which are of various sizes and, therefore, are adapted to receive the pointed portions of syringe structures (not shown) therein for an orderly support and positioning thereof. The support hole members 72 having the support grommets 86 therein are adapted to receive and support, selectively, the tube tree assembly 34 or the transducer pole assembly 36 as required. The tube clamp hole member 72 is adapted to receive a pinched portion of a plastic tube member therein to cease fluid flow therethrough.

The head rest assembly 22 is mounted within the central indentation 50 on the primary tray assembly 18 and selectively movable from the generally horizontal position of FIG. 1 to an inclined position as shown in FIG. 3 supported on the respective leg members 94, 96.

The instrument holder compartment 24 presents a rectangular cavity 112 adapted to receive and confine instrument members therein.

The drape frame assembly 26 is, as shown in FIG. 5, operable to be erected as shown in dotted lines in FIG. 1. The lower ends of the respective support tubes 130, 134 are mounted in respective support holes 128 and surrounded by the grommet members 140. It is noted that this allows for a surgical drape to be draped upwardly onto the top surface of the drape frame assembly 26 to allow the anesthesia provider clear vision to the patient's head area.

The needle remover assembly 28 is provided with a needle plate member 142 mounted about the entrance opening 145 and having a foam member 148 therein. The conventional syringe member is normally provided with an outer cover structure which can be immediately removed by the anesthsia provider utilizing only one hand by placing the cover structure through the entrance opening 145 so that the same will abut an inner surface 148 of the needle plate member 142. The syringe member is then moved outwardly and the cover member is pushed therefrom to fall within the receiving tray member 144 or the open space contained therein.

An additional function of the neddle remover assembly 28 is to unscrew a needle member on the syringe member to replace same if necessary. This is achieved by placing the needle point portion of the syringe member inwardly and down against the serrated edges 149 of the needle plate member 142 and rotating same in a counter clockwise direction as viewed in FIG. 10. This will cause the needle point member to become unscrewed from its support structure and fall within the receiving tray member 144 or the area thereabout.

In regard to the intravenous feed holder assembly 30, the use of the tube holder 150 is shown in FIG. 4 whereupon the plastic tube member 161 is adapted to be inserted within the triangular cavity 158 and grasped by the tube clamp member 156. This allows for retention of the plastic tube member 161 therein which is very important in an intravenous feeding situation.

The stop cock holder member 152 is adapted to hold a stop cock therein while permitting the anesthesia provider to open and close a control valve thereon with the use of only one hand. The stop cock holder 152 can be of various sizes to accommodate various sizes of stop cock members.

The attachment assembly 32 includes the support peg members 174 to which various items can be attached thereto for ease of access and visability as shown in FIG. 14.

As shown in FIGS. 6 and 7, the tube tree assembly 84 is adapted to have the support pole member 182 supported in one of the openings which have the grommet members 86 therein for vertical support. The offset end section 209 is operable to place the transducer support member 206 laterally of the primary tray assembly 18. This allows the transducer members to be mounted within the support openings 214 for convenient, controlled usage thereof. The anesthesia accessories unit 12 of this invention extends outwardly of both sides of the table 114 to allow for proper use of the support hole assemblies 70 on having syringes and other structures therein.

It is noted that the anesthesia accessories unit of this invention is operable to receive and store various supplies, chemicals and instruments needed in the completion of the anesthesia provider duties. The various support members are operable to readily place the intravenous tubing members, air supply tubes, the drapery sheets, and the transducers in proper positions for ready accessability and control thereof.

It is noted that the anesthesia accessories unit can be constructed of a one piece plastic material so as to be easily cleaned. It is noted that the tray assembly is easy to use; rigid in structure; and substantially easy to maintain.

While the invention has been described in conjunction with preferred specific embodiments thereof, it will be understood that this description is intended to illustrate and not to limit the scope of this invention, which is defined by the following claims.

I claim:

1. An anesthesia accessories unit adapted to be supported on an operating room table for use by an anesthesia provider during surgical procedures, comprising:

(a) a primary tray assembly supported on one end of the operating room table adapted to receive a head portion of a patient on a central portion thereof;

(b) a support hole assembly placed on one side of the primary tray assembly to receive and hold syringe members and the like therein;

(c) a head rest assembly mounted on said central portion of said primary tray assembly having a head rest cushion that is adjustable for changing the angle of the patient's head;

(d) an attachment assembly connected to a portion of said primary tray assembly adapted to receive and support accessories thereon; and (e) an intravenous tubing holder connected to said primary tray assembly;

(f) said intravenous tubing holder assembly including a tube holder assembly and a stop cock holder assembly; and (g) said tube holder assembly having a holder support body provided with a triangular cavity to receive and hold a tube member therein.

2. An anesthesia accessories unit as described in claim 1, wherein:

(a) said stop cock holder assembly has a pair of intersecting slots for receiving a stop cock member therein so the same can be readily operated with one hand of the anesthesia provider.

3. An anesthesia accessories unit as described in claim 1, wherein:

(a) said tube holder assembly includes a tube clamp member which is mounted within said triangular cavity; and (b) said tube clamp member is constructed so as to receive and resiliently hold said tube member within said tube holder assembly.

4. An anesthesia accessories unit adapted to be supported on an operating room table for use by an anesthesia provider during surgical procedures, comprising:

(a) a primary tray assembly supported on one end of the operating room table adapted to receive a head portion of a patient on a central portion thereof;

(b) a support hole assembly placed on one side of the primary tray assembly to receive and hold syringe members and the like therein;

(c) a head rest assembly mounted on said central portion of said primary tray assembly having a head rest cushion that is adjustable for changing the angle of the patient's head;

(d) an attachment assembly connected to a portion of said primary tray assembly adapted to receive and support accessories thereon; and (e) a tube tree assembly including a support pole member to be selectively mounted in said primary tray assembly and a tube support member movably mounted upon said support pole member;

(f) said tube support member having a support block member with a tube support plate secured thereto.

5. An anesthesia accessories unit as described in claim 4 wherein:

(a) said tube support plate having a slot section therein to receive an air supply tube member therein and operable to restrict lateral and vertical movement of the air supply tube member.

6. An anesthesia accessories unit adapted to be supported on an operating room table for use by an anesthesia provider during surgical procedures, comprising:

(a) a primary tray assembly supported on one end of the operating room table adapted to receive a head portion of a patient on a central portion thereof;

(b) a support hole assembly placed on one side of the primary tray assembly to receive and hold syringe members and the like therein;

(c) a head rest assembly mounted on said central portion of said primary tray assembly having a head rest cushion that is adjustable for height;

(d) an attachment assembly connected to a portion of said primary tray assembly adapted to receive and support accessories thereon; and (e) a transducer pole assembly having a support pole member releasably mounted in said primary tray assembly and a transducer support member vertically adjustably connected to said support pole member to hold a transducer for conjoint vertical movement with the patient's table.

7. An anesthesia accessories unit as described in claim 6, wherein:

(a) said support pole member having an offset support end sections so as to place said transducer support member laterally of the operating room table.

8. An anesthesia accessories unit adapted to be supported on an operating room table for use by an anesthesia provider during surgical procedures, comprising:

(a) a primary tray assembly supported on one end of the operating room table adapted to receive a head portion of a patient on a central portion thereof;

(b) a support hole assembly placed on one side of the primary tray assembly to receive and hold syringe members and the like therein;

(c) a head rest assembly mounted on said central portion of said primary tray assembly having a head rest cushion that is adjustable for changing the angle of the patient's head;

(d) an attachment assembly connected to a portion of said primary tray assembly adapted to receive and support accessories thereon; and (e) said hole assembly having an instrument support hole with a grommet member therein operable to hold and support an instrument therein.

9. An anesthesia accessories unit as described in claim 8, including:

(a) an instrument holder compartment positioned adjacent said headrest assembly adapted to receive instruments therein.

10. An anesthesia accessories unit as described in claim 8 including:

(a) a drape frame assembly releaseably connected to said primary tray assembly and positioned about said headrest assembly; and (b) said drape frame assembly forming a rectangular frame structure to receive a cover member thereon to hold same away from a patient's head area.

11. An anesthesia accessories unit as described in claim 8, including:

(a) a needle remover assembly secured to a portion of said primary tray assembly; and (b) said needle remover assembly including a needle plate member having an opening therein, whereby a portion of a syringe needle structure may be inserted through said opening in said needle plate member in order to selectively pull off a cover structure or rotate to remove a needle member from a syringe needle structure.

12. An anesthesia accessories unit adapted to be supported on an operating room table for use by an anesthesia provider during surgical procedures, comprising:

(a) a primary tray assembly supported on one end of the operating room table adapted to receive a head portion of a patient on a central portion thereof;

(b) a support hole assembly placed on one side of the primary tray assembly to receive and hold syringe members and the like therein;

(c) a head rest assembly mounted on said central portion of said primary tray assembly having a head rest cushion that is adjustable for changing the angle of the patient's head;

(d) an attachment assembly connected to a portion of said primary tray assembly adapted to receive and support accessories thereon; and (e) said primary tray assembly having a front wall with a connector section formed therein; and (f) said connector section having a slot leading to an opening so that a tube member can be moved transversely of said slot into said opening for support therein.

* * * * *